US005937908A

United States Patent [19]

Inoshiri et al.

[11] Patent Number: 5,937,908

[45] Date of Patent: Aug. 17, 1999

[54] STRAIGHTENING APPARATUS

[75] Inventors: Ryo Inoshiri, Kitakatsuragi-gun; Shozo Tanaka, Nara, both of Japan

[73] Assignee: Sharp Kabushiki Kaisha, Osaka, Japan

[21] Appl. No.: 08/935,860

[22] Filed: Sep. 23, 1997

[30] Foreign Application Priority Data

Oct. 18, 1996 [JP] Japan ..... 8-275700

[51] Int. Cl.[6] ..... F15D 1/08

[52] U.S. Cl. ..... 138/39; 138/37

[58] Field of Search ..... 138/37, 39

[56] References Cited

U.S. PATENT DOCUMENTS

| | | | |
|---|---|---|---|
| 1,837,901 | 12/1931 | Föttinger et al. | 138/39 |
| 2,132,961 | 10/1938 | Morgan | 138/39 |
| 2,813,708 | 11/1957 | Frey | 138/39 |
| 3,185,181 | 5/1965 | Demyan | 138/37 |
| 3,381,713 | 5/1968 | Jacobsen | 138/39 |
| 3,892,546 | 7/1975 | Grisell | 138/37 |
| 4,058,141 | 11/1977 | Hasinger et al. | 138/39 |
| 5,099,879 | 3/1992 | Baird | 138/39 |
| 5,411,438 | 5/1995 | White et al. | 138/39 |

FOREIGN PATENT DOCUMENTS 6-331412 12/1994 Japan .

*Primary Examiner*—Denise L. Ferensic
*Assistant Examiner*—James F. Hook
*Attorney, Agent, or Firm*—Birch, Stewart, Kolasch & Birch, LLP

[57] ABSTRACT

A straightening apparatus is constituted by a diffuser connected to an inflow pipe having a rectangular section to form an enlarged channel, and eight straightening vanes arranged inside the diffuser. The diffuser has a rectangular sectional surface, and is formed to increase its sectional area from a channel inlet to an outlet. Each straightening vane is arranged to set its surface along the flow direction. Instead of completely partitioning the channel by one straightening vane, the straightening vanes are respectively arranged on the upstream and downstream sides in the flow direction at intervals to form an opening portion at the middle portion of the channel without any partition.

7 Claims, 11 Drawing Sheets

STRAIGHTENING APPARATUS

BACKGROUND OF THE INVENTION (1) Field of the Invention

The present invention relates to a straightening apparatus which straightens a fluid flowing through a pipe having a channel with a large sectional area in the flow of the fluid to prevent the loss of the fluid energy, to reduce noise, and to provide a uniform flow velocity distribution at the outlet of the enlarged channel.

(2) Description of the Prior Art

In design of a diffuser, it is the most important to a fluid while its energy loss in a channel having a large sectional area is minimized. Many studies have been made for diffusers so far, and the design technique of a typical shape is nearly established. For example, according to the results of the Gibson's experiment, a conical diffuser has the relationship between the spread angle 2θ of the diffuser and the diffuser efficiency like the one shown in FIG. 1, and the optimal spread angle is 6 to 8° when the sectional area ratio of the channel falls within the range of 2.3 to 9. The optimal spread angle is about 6° in a pyramidal diffuser having a square sectional shape, and about 11° in a two-dimensional diffuser. In this manner, an optimal diffuser shape is designed on the basis of the sectional area ratio of the channel and the diffuser length for each diffuser shape. However, as is apparent from the above example, since the optimal spread angle is very small, a channel having a higher sectional area ratio requires a longer diffuser, resulting in a bulky main body. When the diffuser has a spread angle larger than the above one, a method of inserting a straightening vane in the pipe to divide the channel into channels each having a smaller spread angle is employed. Accordingly, fluid flows along the wall surface of the diffuser and the straightening vane to suppress separation and reduce the energy loss.

In the conventional method, however, a straightening vane having a large spread angle must be arranged in a diffuser having a spread angle much larger than the one shown in FIG. 1. As a consequence, the fluid flows along a surface of the straightening vane and apart from another surface, and the flow velocity distribution greatly varies at the diffuser outlet. If the number of straightening vanes is increased to prevent an increase in spread angle of the straightening vane, the straightening vanes narrow channels to interfere the flow, and the energy loss cannot be reduced.

SUMMARY OF THE INVENTION

The present invention has been made to solve the conventional problems, and has as its object to provide a straightening apparatus capable of suppressing the turbulence of a fluid and separation from a wall surface that occurs in an enlarged channel, reducing noise, providing uniform the flow velocity distribution at the outlet of the enlarged channel, realizing downsizing, and controlling the flow direction of the discharged fluid.

The invention according to the first aspect is a straightening apparatus comprising a diffuser which enlarges a channel for a fluid flowing from an inflow pipe, and straightening vanes arranged along the channel in the diffuser to partition the channel, the straightening vanes having an opening portion at a middle portion of the straightening vane. In this invention, since the straightening vanes having an opening portion are set, fluid is allowed to flow in and out between the straightening vanes, and separation of the fluid from the straightening vanes can be suppressed.

The invention according to the second aspect is a straightening apparatus wherein, in the straightening apparatus defined in the first aspect, only straightening vanes arranged in a direction to enlarge the channel extending from the inflow pipe have the opening portion. In this invention, since fluid is allowed to flow in and out between the straightening vanes having the opening portion, and no opening portion is formed in the straightening vane arranged parallel to the channel, the flow direction can be stabilized.

The invention according to the third aspect is a straightening apparatus comprising a diffuser which enlarges a channel for fluid flowing from an inflow pipe, and a wing-shaped straightening vane arranged along the channel in the diffuser to partition the channel. In this invention, since the straightening vane has a wing shape, separation at the back surface of the straightening vane is suppressed. Since the fluid flows along the straightening vane, variations in flow velocity distribution are also reduced.

The invention according to the fourth aspect is a straightening apparatus comprising a diffuser which enlarges a channel for a fluid flowing from an inflow pipe, and a straightening vane which is arranged along the channel to extend from an interior of the diffuser to the inflow pipe, and partitions the channel. In this invention, since the straightening vane is made longer than the diffuser, the same effects as those obtained by elongating the diffuser can be obtained. The invention according to the fifth aspect is a straightening apparatus comprising a diffuser which enlarges a channel for a fluid flowing from an inflow pipe, and a straightening vane arranged along the channel in the diffuser to partition the channel, wherein, at a channel inlet of the diffuser, an arrangement position of the straightening vane is set on the basis of a flow velocity distribution of the inflow pipe to equalize flow rates of the fluid flowing through channels partitioned by the straightening vane, and at a channel outlet, set to uniformly divide a channel area. In this invention, the flow velocity of the fluid discharged from the diffuser outlet can be further uniformed.

The invention according to the sixth aspect is a straightening apparatus comprising a diffuser which enlarges a channel for a fluid flowing from an inflow pipe, and a straightening vane arranged along the channel in the diffuser to partition the channel, wherein a space is defined at a back portion of a wall surface of the diffuser on a channel inlet side, and a portion which partitions the channel and the space is constituted to be openable. In this invention, with the structure of opening/closing the partition portion, fluid is allowed to flow in the space, and separation of the fluid from the wall surface is promoted to control the flow direction of the fluid.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Embodiments of the present invention will be described below with reference to the accompanying drawings.

First Embodiment

Figure 1:
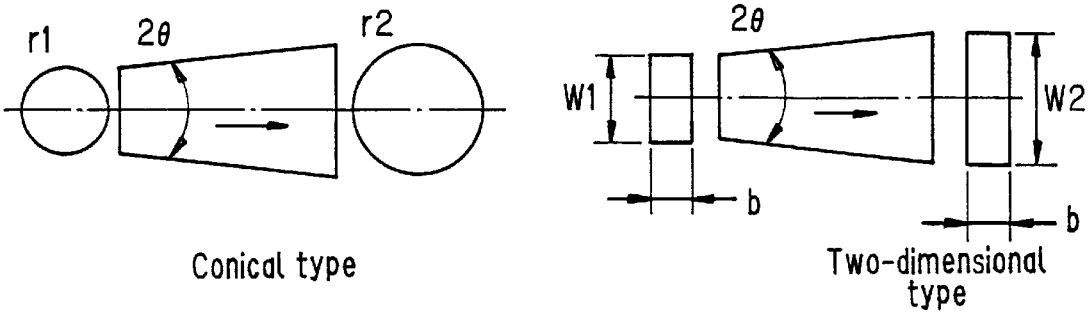
FIG. 1 PRIOR ART
FIG. 1 is a graph showing the relationship between the spread angle and diffuser efficiency of a diffuser on the basis of the results of the Gibson's experiment.
Figure 1:
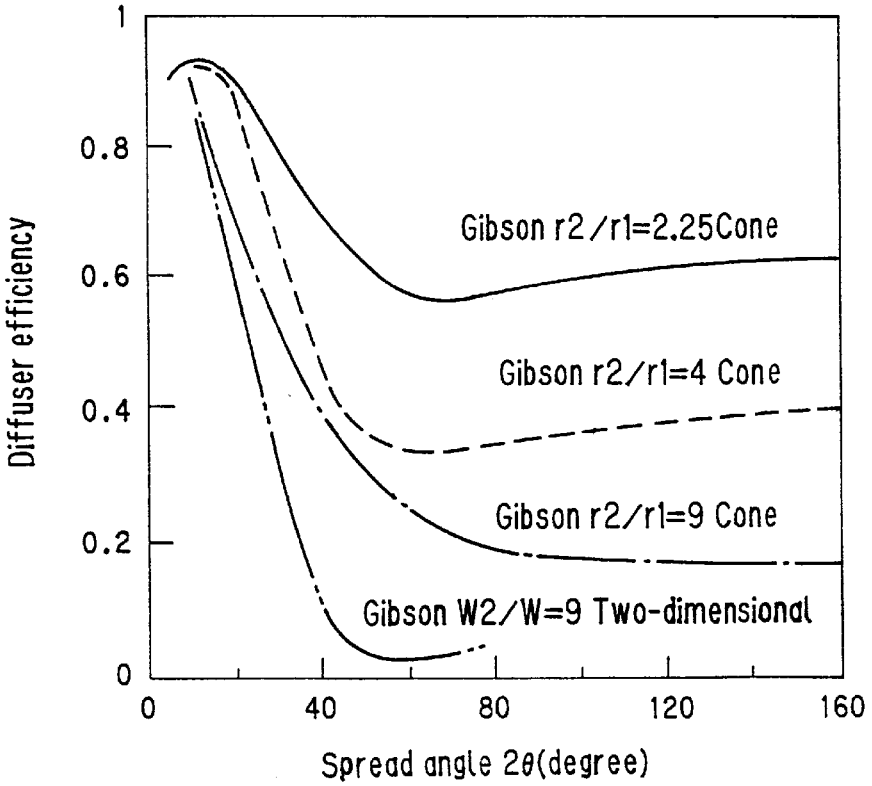
FIG. 1 PRIOR ART
Figure 2:
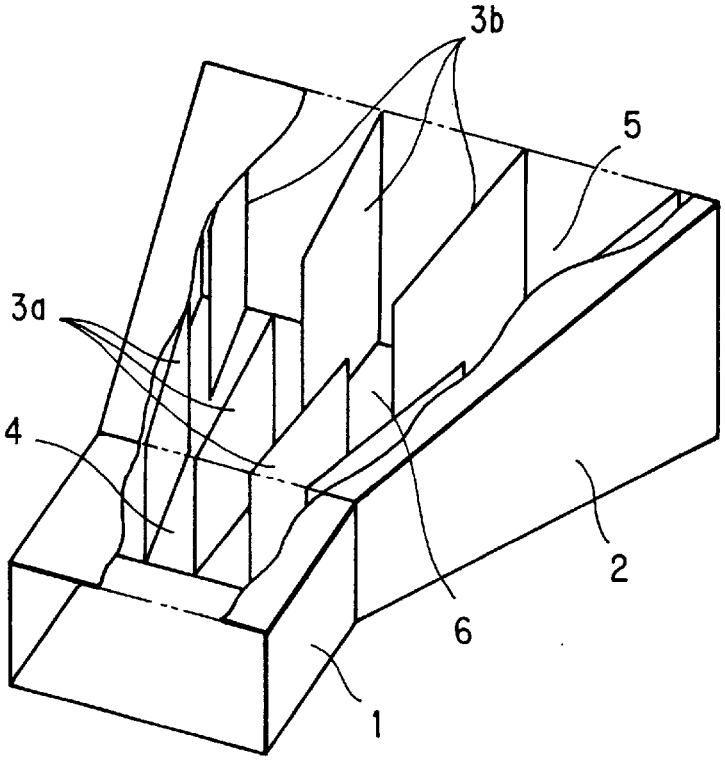
FIG. 2 is an explanatory view schematically showing a straightening apparatus according to the first embodiment of the present invention.

FIG. 2 is an explanatory view schematically showing a straightening apparatus according to the first embodiment of the present invention. This straightening apparatus is constituted by a diffuser 2 connected to an inflow pipe 1 having a rectangular section to form an enlarged channel, and, e.g., eight straightening vanes 3*a* and 3*b* arranged inside the diffuser 2. The diffuser 2 has a rectangular section, and is formed to increase its sectional area from a channel inlet 4 to an outlet 5. Each straightening vane 3 is arranged to set its surface along the flow direction. Instead of completely partitioning the channel by one straightening vane, the straightening vanes 3*a* and 3*b* are respectively arranged on the upstream and downstream sides in the flow direction at intervals to form an opening portion 6 at the middle portion of the channel without any partition.

Figure 3:
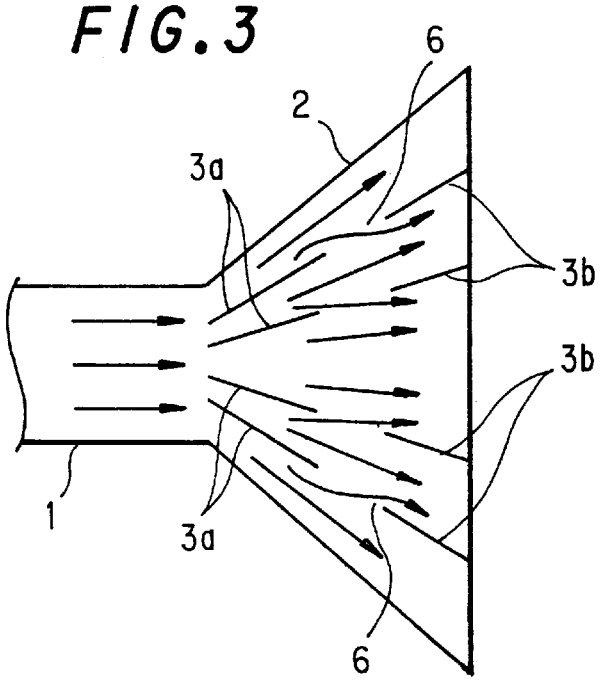
FIG. 3 is an explanatory view showing a direction in which a fluid flows through the diffuser.

FIG. 3 is an explanatory view showing a direction in which a fluid flows through the diffuser. Since the straightening vanes 3 are arranged to form the opening portion 6 at the middle portion of the channel, the straightening vanes 3 do not completely divide the channel to allow the fluid to flow in and out between the straightening vanes. As a result, the fluid flows to prevent natural occurrence of turbulence, and the vanes suppress separation of the fluid from the straightening vanes 3*a* and 3*b* and separation of the fluid from the wall surface portion of the diffuser 2. In this manner, noise caused by the turbulence of the fluid or the like can be reduced. Since the fluid flows along the straightening vanes 3*a* and 3*b*, variations in flow velocity distribution are reduced to provide a uniform flow velocity distribution at the diffuser outlet 5. Since the straightening vanes 3*a* and 3*b* do not interfere the flow, the energy loss is small. Even if the spread angle of the diffuser 2 is increased, separation of the fluid from the straightening vane 3, and separation of the fluid from the wall surface portion of the diffuser 2 are suppressed. Therefore, a very compact straightening apparatus having the diffuser 2 with a large spread angle can be manufactured.

Figure 4:
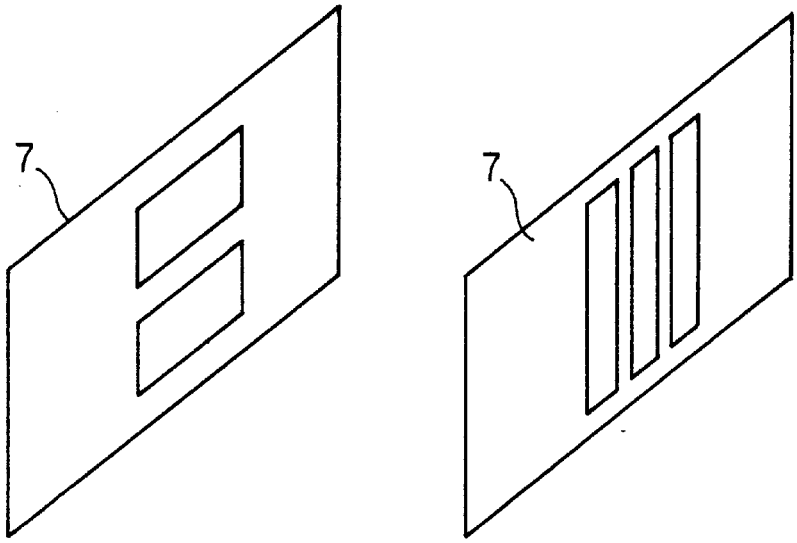
FIG. 4 is a view showing another shape of a straightening vane.

FIG. 4 is a view showing another shape of the straightening vane. As shown in FIG. 4, slits or holes are formed in the middle portion of a straightening vane 7, and the straightening vane 7 is arranged along the channel. If the straightening vane 7 is used, the same effects as those described above can be obtained because the opening portion exists at the middle portion. Since only one straightening vane 7 suffices to be arranged in the flow direction, the straightening apparatus can be easily assembled.

Figure 5:
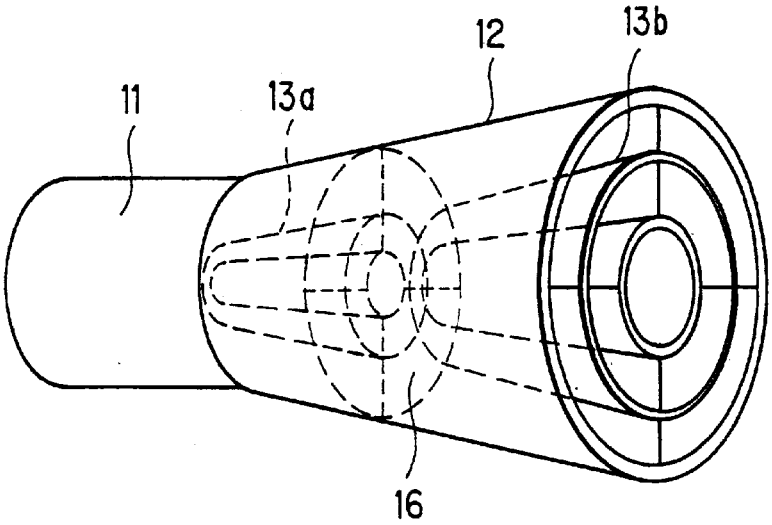
FIG. 5 is an explanatory view schematically showing a straightening apparatus having a cylindrical diffuser.

FIG. 5 is an explanatory view schematically showing a straightening apparatus having a cylindrical diffuser. This straightening apparatus is constituted by a diffuser 12 connected to an inflow pipe 11 having a circular section to form an enlarged channel, and straightening vanes 13*a* and 13*b* arranged inside the diffuser 12. The diffuser 12 has a circular section, and is formed to increase its sectional area from the channel inlet to the outlet. The straightening vanes 13*a* and 13*b* are arranged to set their surfaces along the flow direction. Instead of completely partitioning the channel by one straightening vane, the straightening vanes 13*a* and 13*b* are respectively arranged on the upstream and downstream in the flow direction to form an opening portion 6 therebetween. In this manner, the shapes of the straightening vane and the diffuser are not limited to those described in the first embodiment, and various shapes can be applied.

Second Embodiment

Figure 6:
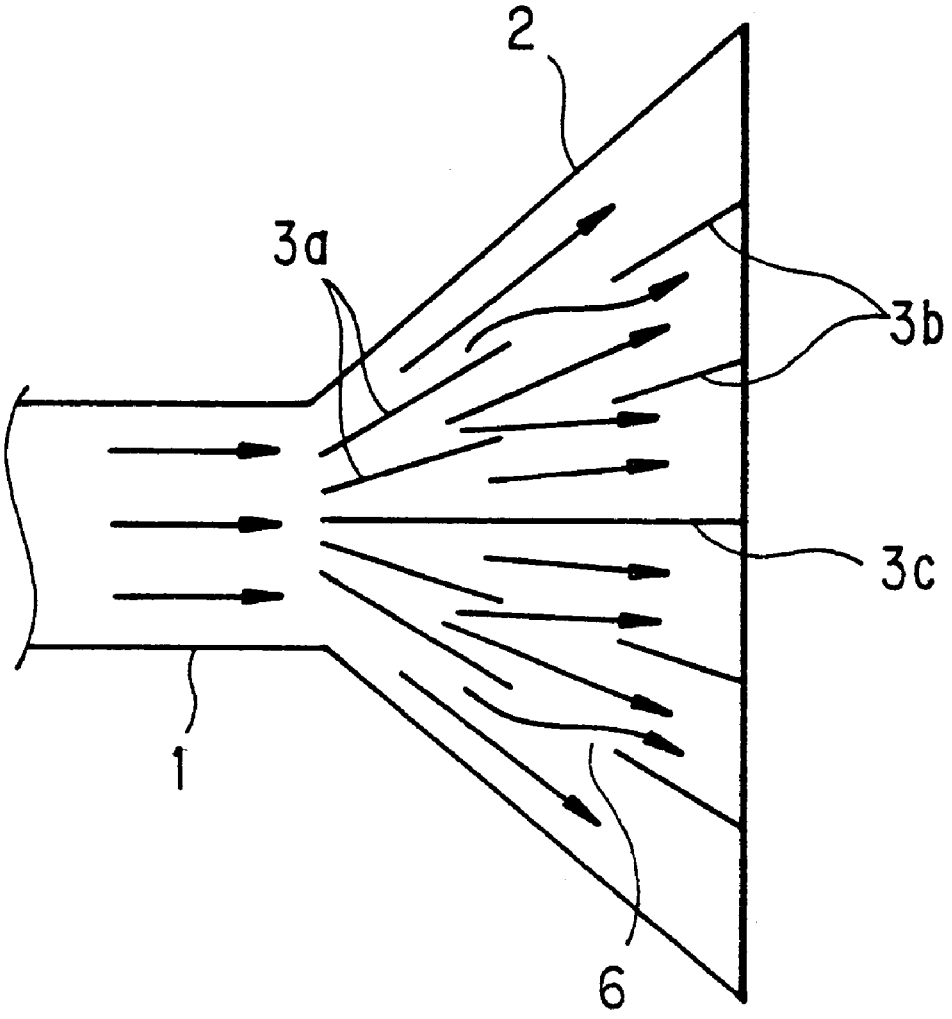
FIG. 6 is an explanatory view schematically showing a straightening apparatus according to the second embodiment of the present invention.

FIG. 6 is an explanatory view schematically showing a straightening apparatus according to the second embodiment of the present invention. This straightening apparatus is characterized by a straightening vane arranged inside the diffuser 2 of the first embodiment. More specifically, a straightening vane 3*c* having no opening portion is arranged at a central portion in the diffuser 2 of the first embodiment to divide the interior of the diffuser 2 into two spaces. In each space partitioned by the straightening vane 3*c*, e.g., two straightening vanes 3*a* and two straightening vanes 3*b* are arranged. That is, no opening portion is formed in the straightening vane 3*c* arranged parallel to a channel extending from an inflow pipe 1, while an opening portion is formed between the straightening vanes 3*a* and 3*b* arranged in a direction to enlarge the channel. In the case of FIG. 6, since the flow at the central portion in the diffuser 2 is parallel to the flow direction in the inflow pipe 1, the straightening vane 3*c* arranged at the center is parallel to the flow direction, and separation from a fluid is small. For this reason, if the straightening vane 3*c* having no opening portion is arranged, the fluid can flow along the straightening vane to further reduce the energy loss. According to the second embodiment, the fluid can flow in and out between the straightening vanes near a wall surface having a large spread angle, separation of the fluid from the straightening vane can be suppressed, while the flow at the central portion can be stabilized by the straightening vane 3*c* having no opening portion. With this design the energy loss can be reduced.

Figure 7A:
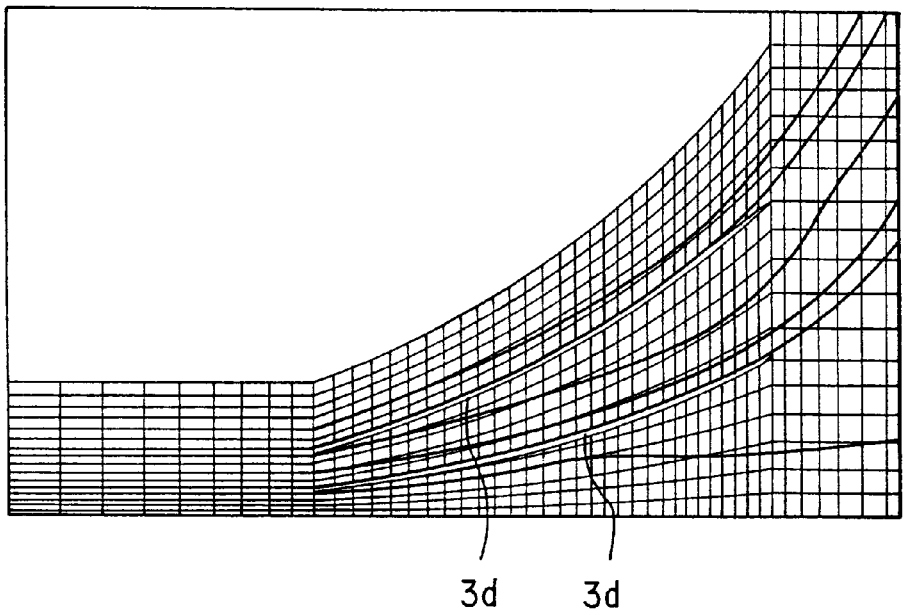
FIGS. 7A and 7B are explanatory views, respectively, showing the analyzed flow of a fluid from an inflow pipe that is represented by stream lines.
Figure 7B:
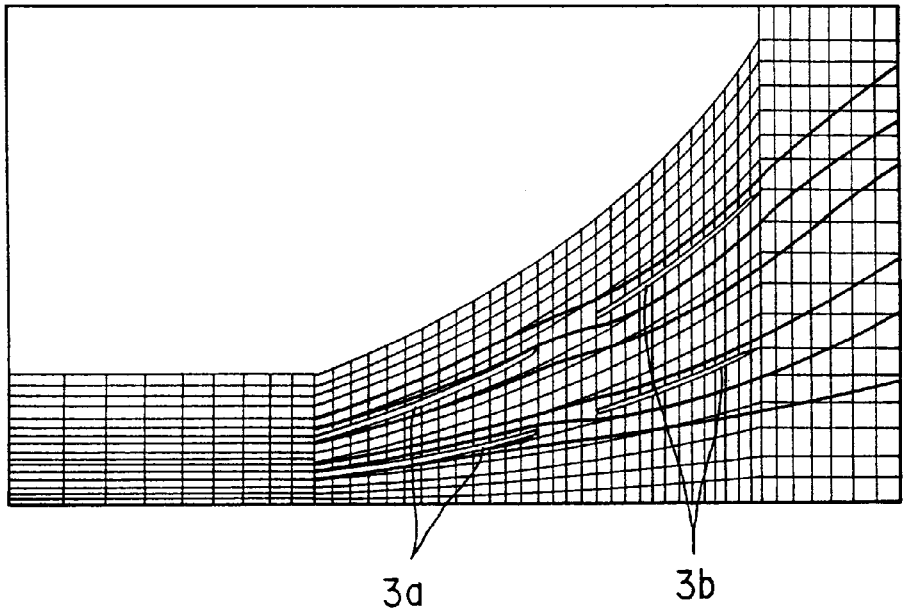

The examination results of a numerical analysis of the straightening apparatus according to the second embodiment will be described. FIGS. 7A and 7B are explanatory views, respectively, showing the analyzed flow of a fluid from the inflow pipe that is represented by stream lines. FIG. 7A shows the case of conventional straightening vanes 3*d* having no opening portion, and FIG. 7B shows the case wherein the straightening vanes 3*a* and 3*b* having an opening portion therebetween according to the present invention are arranged. Thick lines are stream lines, and the start points of the stream lines are the same in both FIGS. 7A and 7B. In FIG. 7A, the flow changes at the boundary of the straightening vane 3*d*, and a flow along the straightening vane 3*d* and a flow apart from the straightening vane 3*d* are clearly represented by stream lines. In FIG. 7B, part of a flow along the straightening vane 3*a* flows inward through the opening portion between the straightening vanes, and this flow also flows along the straightening vane 3*b*. A flow through the inside of the straightening vane 3*a* is guided by the flow passing through the opening portion between the straightening vanes to flow along the straightening vane 3*b* much more than the case of FIG. 7A.

Figure 8:
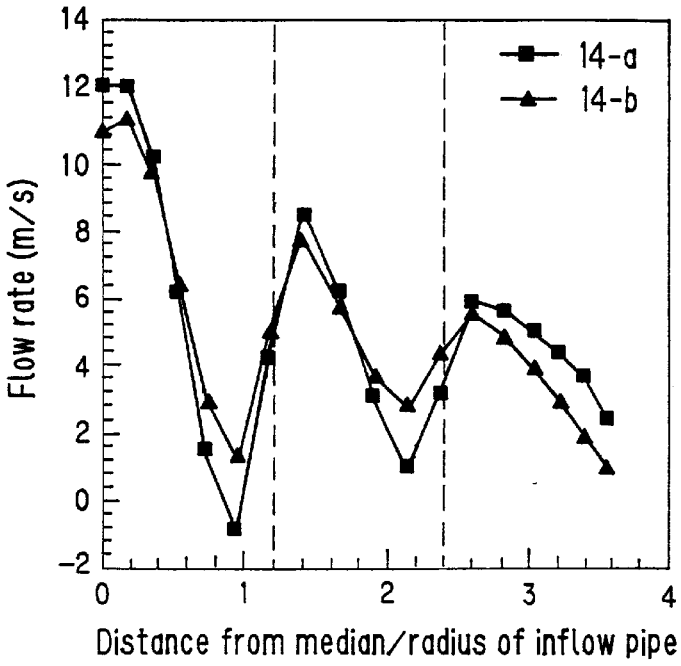
FIG. 8 is a graph showing the flow velocity distribution at a diffuser outlet in FIGS. 7A and 7B.

The flow velocity distribution at the diffuser outlet will be described. FIG. 8 is a graph showing the flow velocity distribution at the diffuser outlet in FIGS. 7A and 7B. In FIG. 8, 14-*a* represents data of the straightening apparatus shown in FIG. 7A, and 14-*b* represents data of the straightening apparatus shown in FIG. 7B. As a whole, the flow velocity alternately increases and decreases. The straightening vanes are located at portions indicated by broken lines where the flow velocity changes from low to high. Since the straightening vanes except for the central one are inserted in a spread direction toward the diffuser outlet, the two surfaces of each straightening vane are distinguished into a diffuser-wall-side surface and a center-side surface. The flow velocity on the diffuser-wall-side surface of the straightening vane is high because the fluid flows along the straightening vane, whereas the flow velocity on the center-side surface is low because the fluid separates from the surface. The flow velocity represented by 14-*b* is lower than that represented by 14-*a* at the central portion, and the flow velocity difference before and after the straightening vane is small. This reveals that the flow velocity at the diffuser outlet is also uniformed.

To obtain the reduction degree of variations in flow velocity distribution at the outlet, the deviation of the outlet flow velocity from a target flow velocity was calculated. The deviation of the outlet flow velocity from the target flow velocity is a value obtained such that a target flow velocity value (average value calculated from the flow rate and the outlet area) at the diffuser outlet is set, and the deviation of the outlet flow velocity from the target value is calculated and mean-squared. A smaller numerical value represents smaller variations. As a consequence, the deviation of the straightening apparatus having data 14-*a* was 6.2, and that of the straightening apparatus having data 14-*b* was 3.6, which indicates that variations in flow velocity distribution are greatly improved.

To obtain the reduction degree of the pressure loss, the diffuser efficiency was calculated. The diffuser efficiency represents, of the reduction amount of the kinetic energy of the air flow, the percentage used to recover the static pressure. If the pressure loss is 0, the diffuser efficiency is 100%. The arithmetic expression of the diffuser efficiency is Diffuser Efficiency=(Actually Obtained Increase in Static Pressure)/(Dynamic Pressure of Average Inlet Flow Velocity-Dynamic Pressure of Average Outlet Flow Velocity)

From this expression, the diffuser efficiency of the straightening apparatus having data 14-*a* was 64%, and that of the straightening apparatus having data 14-*b* was 74%. This reveals that the diffuser efficiency of the straightening apparatus having data 14-*b* was higher by 10% than that of the straightening apparatus having data 14-*a*.

Third Embodiment

Figure 9A:
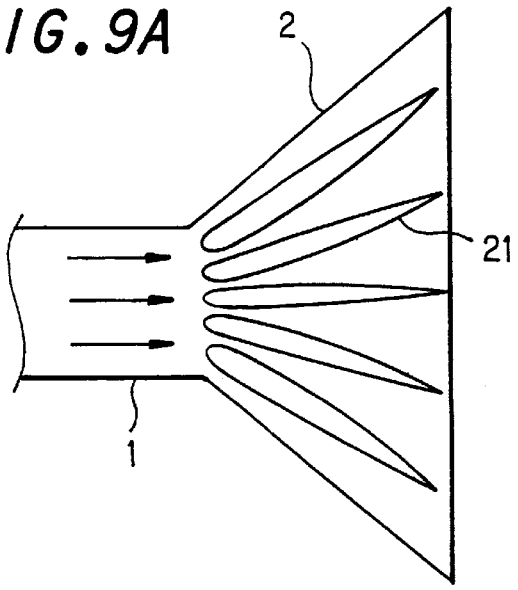
FIGS. 9A and 9B are explanatory views, respectively, schematically showing a straightening apparatus according to the third embodiment of the present invention.
Figure 9B:
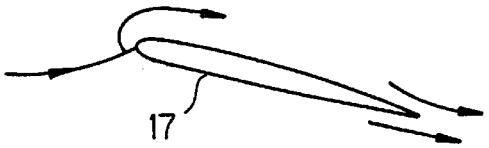

FIG. 9A is an explanatory view schematically showing a straightening apparatus according to the third embodiment of the present invention. In this straightening apparatus, e.g., four laminar flow wing-shaped straightening vanes 21 are arranged along the flow direction inside the diffuser 2 of the first embodiment. In general, when a wing travels through a fluid to generate a lift, the average pressure on the lower surface of the wing is high, and that on the upper surface is low. This indicates that, from the Bernoulli's theorem, the velocity on the upper surface of the wing is averagely higher than that on the lower surface, and that a circulating flow that acts to increase the flow velocity on the upper surface and decrease that on the lower surface exists around the wing (see FIG. 9B). Accordingly, if the wing-shaped straightening vanes 21 are arranged inside the diffuser, the fluid hardly separates from the straightening vanes 21, and an increase in flow velocity can be suppressed to a certain degree. On a boundary layer along the wing, the pressure drops upstream, and rises downstream. The boundary layer easily peels around the back wing edge accompanied with the pressure rise, and a disturbance is greatly amplified to substantially cause turbulence. To the contrary, the laminar flow state may continue on the boundary layer with the pressure drop. A frictional resistance on the laminar flow boundary layer is lower than that on the turbulence boundary layer. Therefore, by using a laminar flow wing (e.g., a wing of the NACA 65 system) in which a position having the maximum wing thickness is set back, the pressure drop area can be widened, the transition of the boundary layer can be delayed, and the frictional resistance can be decreased. In this manner, the energy loss of the fluid flowing in the diffuser can be reduced.

Fourth Embodiment

Figure 10:
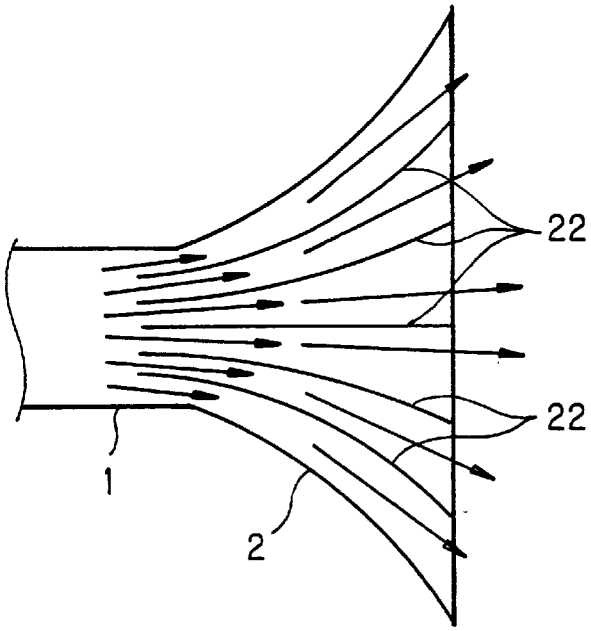
FIG. 10 is an explanatory view schematically showing a straightening apparatus according to the fourth embodiment of the present invention.

FIG. 10 is an explanatory view schematically showing a straightening apparatus according to the fourth embodiment of the present invention. In this straightening apparatus, a straightening vane 22 set in the flow direction inside the enlarged channel of a diffuser 2 is extended to an inflow pipe 1. For example, four straightening vanes 22 are arranged with or without an opening portion. Since the straightening vane 22 is made longer than the diffuser 2, the same effects as those obtained by elongating the diffuser can be obtained. Consequently, the turbulence of a fluid that occurs in the enlarged channel can be suppressed, the energy loss can be reduced, and the flow velocity distribution at the outlet of the enlarged channel can be made uniform.

Figure 11:
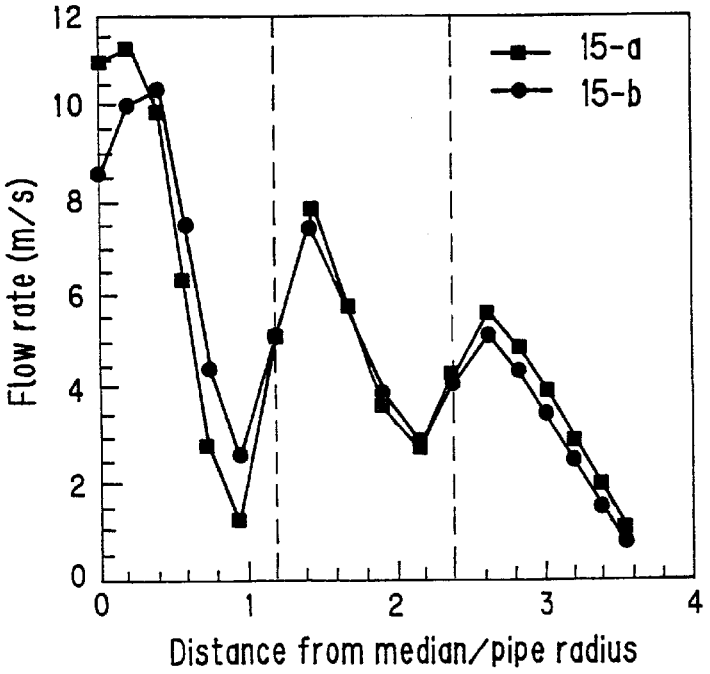
FIG. 11 is a graph showing the flow velocity distribution at the diffuser outlet when a straightening vane is attached in only the diffuser, and that when the straightening vane is extended to the inflow pipe.

The examination results of a numerical analysis of the fourth embodiment will be described. FIG. 11 is a graph showing the flow velocity distribution at the diffuser outlet when the straightening vane is attached in only the diffuser, and that when the straightening vane is extended to the inflow pipe. Data 15-*a* represents the case wherein the straightening vane is attached in only the diffuser, and data 15-*b* represents the case wherein the straightening vane is extended to the inflow pipe. The arrangement positions of the straightening vanes inside the diffusers having data 15-*a* and data 15-*b* are the same though their lengths are different. Broken lines indicate the positions of the straightening vanes at the diffuser outlet. From these results, the flow velocity represented by 15-*b* was lower than that represented by 15-*a* at the central portion, and the flow velocity difference before and after the straightening vane was small. This can be considered that elongation of the straightening vane led to the same effects as those obtained when the diffuser itself was elongated. The deviation of the outlet flow velocity from the target flow velocity when a straightening vane had an opening portion was improved from 3.6 to 3.1, and the diffuser efficiency was increased from 74% to 82%.

Fifth Embodiment

Figure 12:
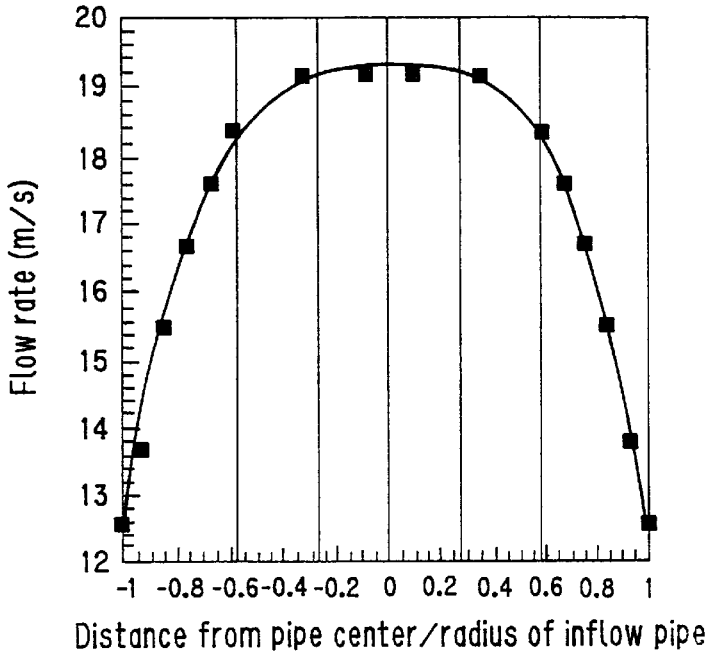
FIG. 12 is a graph showing the flow velocity distribution of the fluid flowing through the inflow pipe.

A straightening apparatus according to the fifth embodiment will be described. Generally, the flow velocity of a fluid flowing through a pipe having a uniform pipe diameter is the highest at a central portion, and as the fluid comes near to the wall surface, decreases due to the influence of the viscosity between a wall surface and the fluid. The flow velocity of a fluid flowing in a diffuser also similarly changes. For this reason, at the inlet of an enlarged channel, the positions of straightening vanes are set on the basis of the flow velocity distribution of an inflow pipe portion so as to make uniform the flow rates of sections partitioned by the straightening vanes. At the outlet of the enlarged channel, the positions of the straightening vanes are set to uniformly divide the outlet area. For example, when a fluid flowing through the inflow pipe has a flow velocity distribution shown in FIG. 12, the flow rate can be calculated from the flow velocity and the pipe radius. If the number of straightening vanes attached to the diffuser is five, the number of areas partitioned by the straightening vanes and the wall surfaces of the diffuser is six. At ⅙ of the flow rate, a fluid flows through one area partitioned by the straightening vane and the wall surface of the diffuser. Subsequently, the positions of the straightening vanes at the inlet portion of the diffuser channel are determined from the flow velocity distribution in FIG. 12 so as to set the flow rate of the fluid to be flowed through one area at the calculated value. Thin lines in FIG. 12 indicate the positions of the straightening vanes at the diffuser inlet that are calculated in the above-described manner. At the inlet of the enlarged channel, therefore, the positions of the straightening vanes are set on the basis of the flow velocity distribution of the inflow pipe to equalize flow rates of the fluid flowing in sectional areas partitioned by the straightening vanes. At the outlet, the positions of the straightening vanes are set to uniformly divide the area of the enlarged channel. With this setting, the flow rates of the fluid flowing through the portions partitioned by the straightening vanes can be made uniform while the flow velocity of the fluid discharged from the diffuser outlet is also made uniform.

Figure 13:
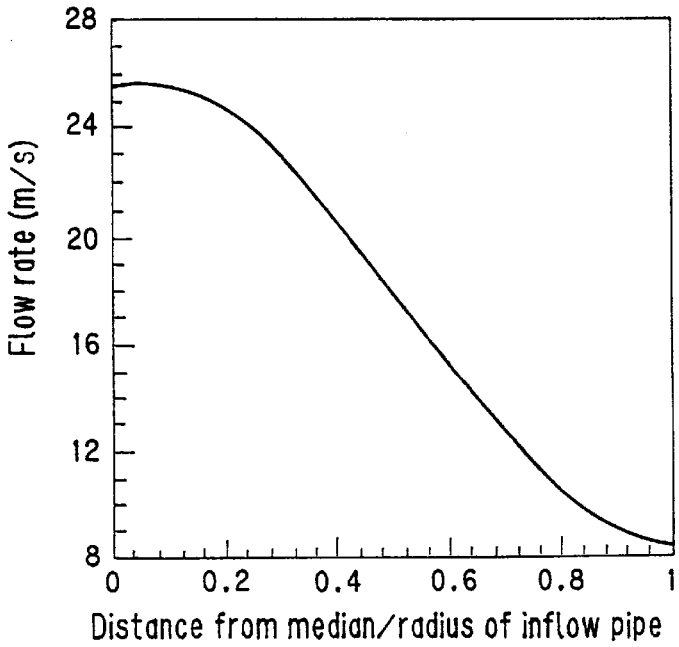
FIG. 13 is a graph showing the flow velocity distribution at a diffuser inlet.
Figure 14A:
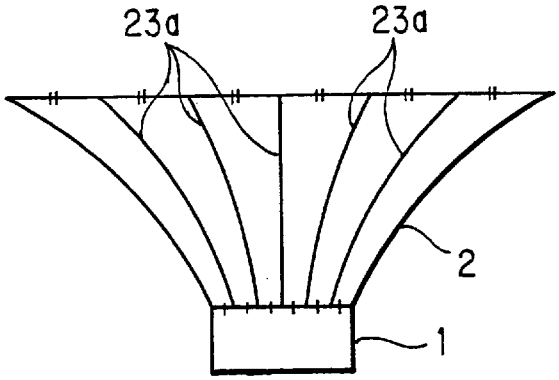
FIGS. 14A and 14B are explanatory views, respectively, showing the case wherein straightening vanes 23*a* are uniformly arranged, and the case wherein the straightening vanes are arranged to equalize the air rate at the diffuser inlet, and uniformly divide the outlet area.
Figure 14B:
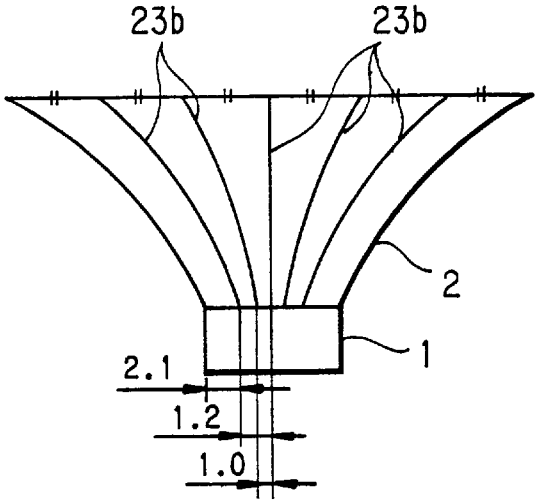

The examination results of a numerical analysis of the fifth embodiment will be described. FIG. 13 is a graph showing the flow velocity distribution at the diffuser inlet. From FIG. 13, the flow velocity difference between a pipe wall and a central portion is found to be 15 m/s or more. On the basis of the flow velocity distribution curves in FIG. 13, the insertion positions of the straightening vanes were determined as shown in FIGS. 14A and 14B. FIG. 14A shows the case wherein the inlet area is uniformly divided by straightening vanes 23*a* in order to attain comparison data. FIG. 14B shows the case wherein the positions of straightening vanes that equalize air rates between straightening vanes 23*b* are set on the basis of the flow velocity distribution at the diffuser inlet in FIG. 13, and the straightening vanes are inserted at the diffuser outlet so as to uniformly divide the outlet area.

Figure 15:
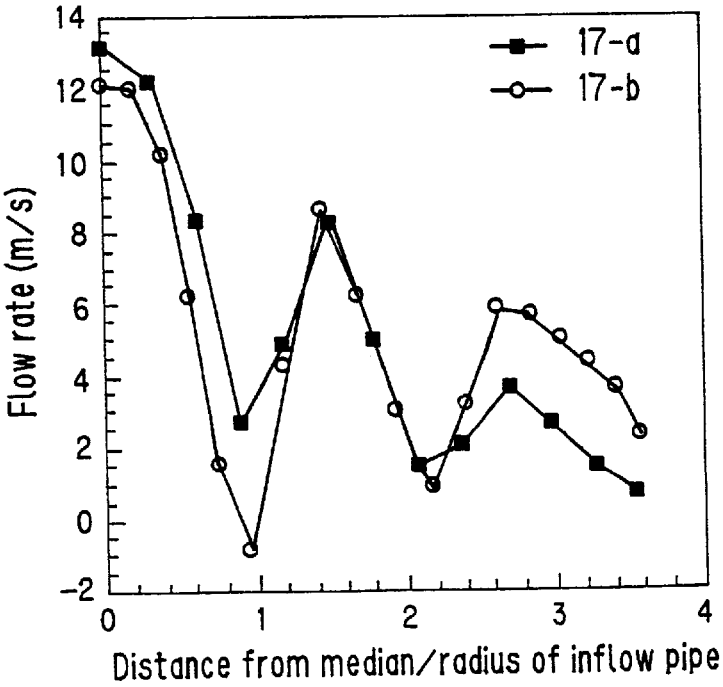
FIG. 15 is a graph showing the flow velocity distribution at the diffuser outlet.

FIG. 15 shows the flow velocity distribution at the diffuser outlet. 17-*a* represents data of the straightening apparatus in FIG. 14A, and 17-*b* represents data of the straightening apparatus in FIG. 14B. The straightening vanes are set at positions where the flow velocity changes from low to high. Since the straightening vanes except for a central straightening vane are inserted in a spread direction toward the outlet of a diffuser 2, the two surfaces of each straightening vane are distinguished into a diffuser-wall-side surface and a center-side surface. The flow velocity on the diffuser-wall-side surface of the straightening vane is high because air flows along the straightening vane, whereas the flow velocity on the center-side surface is low because an air flow separates from the center-side surface. In comparison with data 17-*a* obtained when the straightening vanes 23*a* are uniformly inserted, data 17-*b* represents that the flow velocity difference before and after the straightening vane 23*b* is large because the spread angle of the straightening vane 23*b* is large, but the flow velocity at the outlet portion is 2 m/s or more even near the wall surface, and no separating flow is generated. The deviation of the outlet flow velocity from a target flow velocity was found to be 6.2 for 17-*b* as compared to 11.6 for 17-*a*. It is found that variations in flow velocity distribution were reduced which indicated that the flow velocity distribution at the outlet was made uniform.

Sixth Embodiment

Figure 16:
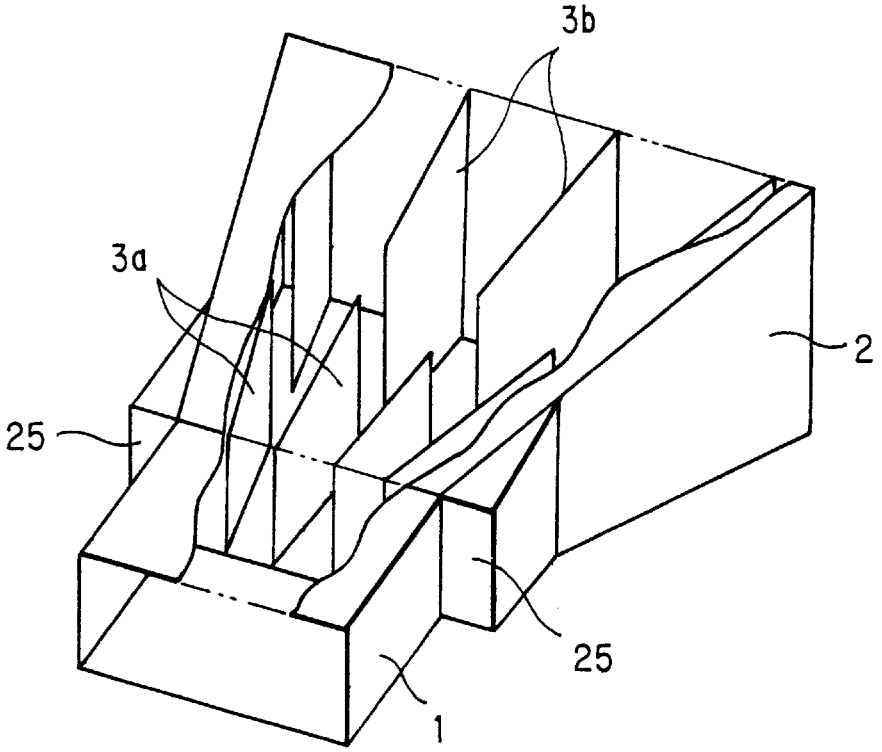
FIG. 16 is an explanatory view schematically showing a straightening apparatus according to the sixth embodiment of the present invention.
Figure 17A:
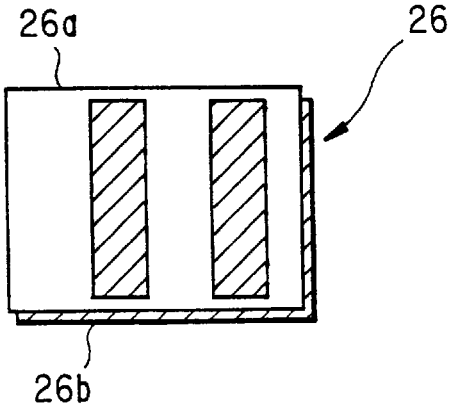
FIGS. 17A and 17B are explanatory views, respectively, schematically showing the shutter operation.
Figure 17B:
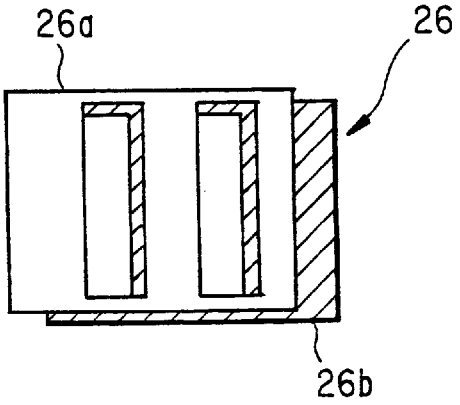

FIG. 16 is an explanatory view schematically showing a straightening apparatus according to the sixth embodiment of the present invention. This straightening apparatus is constituted such that spaces 25 are defined at the back portions of the two wall surfaces of a diffuser 2 on the channel inlet side in the straightening apparatus of the first embodiment in FIG. 2, and an opening/closing shutter is disposed at a portion where the spaces and a channel are partitioned. As shown in FIGS. 17A and 17B, a shutter 26 for opening/closing the spaces 25 is constituted by two shutter plates 26*a* and 26*b* each having two opening portions. By sliding the shutter plates 26*a* and 26*b*, the spaces 25 can be freely opened and closed. When the opening portions of the shutter plates 26*a* and 26*b* do not overlap with each other, as shown in FIG. 17A, the shutter 26 is closed. When the opening portions of the shutter plates 26*a* and 26*b* overlap with each other, as shown in FIG. 17B, the shutter is opened. The flow direction of a fluid is known to be always a direction in which the fluid flows the most easily. For this reason, when the flow direction of the fluid is parallel to a wall surface, the fluid easily flows along the wall surface. If the fluid flow is made difficult in either the right or left directions to promote separation of the fluid from this wall surface, the flow direction of the fluid can be controlled. For example, when an discharged fluid is desired to be flowed rightward, if the left shutter is opened to define a space and promote separation of the fluid from the left wall surface, the fluid easily flows rightward, and thus the fluid flows right at the diffuser outlet. When the fluid is desired to be flowed left, the right shutter is opened. In this manner, the flow direction of the fluid can be controlled by a simple apparatus. Although this embodiment employs the opening/closing shutter in order to define a space, the present invention is not limited to this method because the flow direction can be controlled as far as separation can be promoted.

Figure 18:
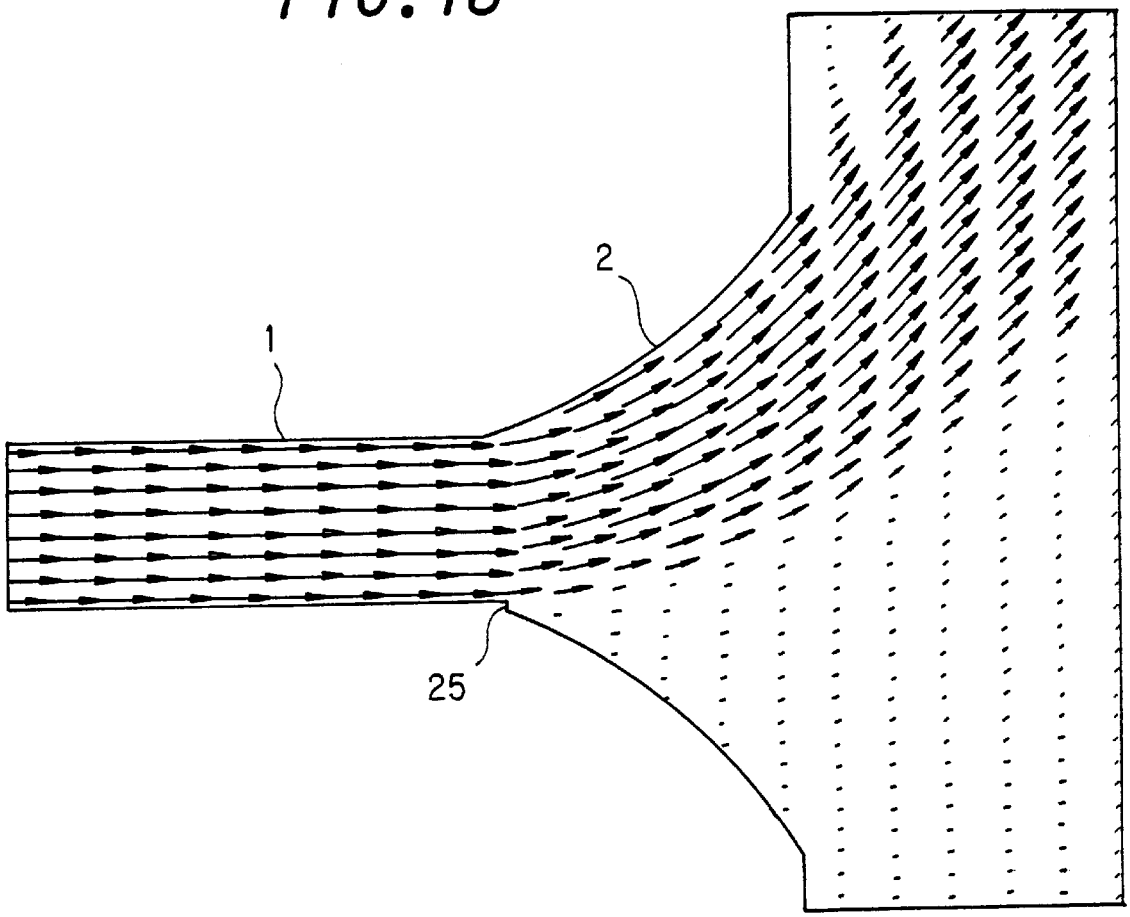
FIG. 18 is a view of the vectors of a fluid flowing through a diffuser having a space defined on the right.

The examination results of a numerical analysis of the sixth embodiment will be described below. FIG. 18 is a view of the vectors of a fluid flowing through a diffuser having a space defined on the right. From FIG. 18, since the flow of a right fluid does not flow along a wall surface but separates therefrom, the whole fluid flowing through the diffuser flows leftward. This reveals that the flow direction of the fluid can be easily controlled by promoting separation of the fluid from the diffuser wall.

According to the first gist of the present invention, since straightening vanes having an opening portion are set, a fluid is allowed to flow in and out between the straightening vanes, separation of the fluid from the straightening vanes can be suppressed, and noise and the energy loss of the fluid can be reduced. Since the fluid flows along the straightening vanes, variations in flow velocity distribution are reduced to make uniform the flow velocity distribution at the diffuser outlet.

According to the second gist of the present invention, since only the straightening vanes arranged in a direction to enlarge the channel extending from the inflow pipe have the opening portion, the fluid is allowed to flow in and out between the straightening vanes. Since the straightening vane arranged parallel to the channel does not have any opening portion, one continuous straightening vane having no opening portion can stabilize the flow direction to further reduce the energy loss.

According to the third gist of the present invention, since the straightening vane has a wing shape, separation at the back surface of the straightening vane is suppressed. Since the fluid flows along the straightening vane, variations in flow velocity distribution are reduced to make uniform the flow velocity distribution at the diffuser outlet.

According to the fourth gist of the present invention, since the straightening vane is made longer than the diffuser by arranging the straightening vane to extend from the interior of the diffuser to the inflow pipe, the same effects as those obtained by elongating the diffuser can be obtained. Therefore, the turbulence of the fluid and separation from a wall surface that occur in the enlarged channel can be suppressed, and the flow velocity distribution at the outlet of the enlarged channel can be uniformed.

According to the fifth gist of the present invention, at the channel inlet of the diffuser, the arrangement positions of the straightening vanes are set on the basis of the flow velocity distribution of the inflow pipe so as to equalize flow rates of the fluid flowing through channels partitioned by the straightening vanes, and at the channel outlet, they are set to uniformly divide the channel area. Therefore, the flow velocity of the fluid discharged from the diffuser outlet can be further uniformed.

According to the sixth gist of the present invention, a space is defined at the back portion of the wall surface of the diffuser on the channel inlet side, and a portion which partitions the channel and the space is constituted to be openable. With a simple structure of opening/closing the partition portion, the fluid is allowed to flow in the space, and separation of the fluid from the wall surface is promoted to control the flow direction of the fluid.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A straightening apparatus comprising:

an inflow pipe having a fluid flowing therethrough;

a diffuser having an inlet and outlet, said diffuser being in fluid communication with said inflow pipe and receiving the fluid from said inflow pipe through said inlet;

a first set of straightening vanes disposed adjacent to said inlet of said diffuser;

a second set of straightening vanes disposed adjacent to said outlet of said diffuser, each vane of said first set is substantially aligned with a corresponding vane of said second set; and an opening portion disposed between said first set and said second set of straightening vanes, said opening portion permitting fluid flow between corresponding pairs of straightening vanes in said first set relative to pairs of straightening vanes in said second set, and fluid flow between pairs of straightening vanes in said first set and pairs of straightening vanes in said second set which are off set relative to said first set, whereby said straightening vanes substantially reduce energy loss, turbulence, and noise of the fluid while providing substantially uniform velocity of the fluid at said outlet of said diffuser.

2. A straightening apparatus comprising:

an inflow pipe having a fluid flowing therethrough;

a diffuser having an inlet and outlet, said diffuser being in fluid communication with said inflow pipe and receiving the fluid from said inflow pipe through said inlet; and a plurality of straightening vanes disposed adjacent to said inlet of said diffuser, each straightening vane having a substantially wing-shaped cross section which includes a first end and a second end, each first end having a thickness being substantially greater than a thickness of a respective second end, said straightening vanes substantially widening a pressure drop area while substantially delaying a transition boundary layer and substantially decreasing frictional resistance of said vanes, said vanes substantially reducing fluid flow energy loss in said diffuser.

3. The straightening apparatus according to claim 2, wherein each first end of each vane is disposed adjacent to said inlet while each said second end of each vane is disposed adjacent to said outlet.

4. A straightening apparatus comprising:

an inflow pipe having a fluid flowing therethrough;

a diffuser having an inlet and an outlet, said diffuser having a first length, said diffuser being in fluid communication with said inflow pipe and receiving the fluid from said inflow pipe through said inlet; and a plurality of straightening vanes, each straightening vane having a first end and a second end, each straightening vane having a second length, each first end being positioned within said inflow pipe and each second end being positioned at said outlet of said diffuser, each second length of a respective straightening vane being substantially longer than said first length of said diffuser, whereby said straightening vanes substantially reduce turbulence and energy loss of the fluid while providing substantially uniform velocity of the fluid at said outlet of said diffuser.

5. A straightening apparatus comprising:

an inflow pipe having a fluid flowing therethrough;

a diffuser having an inlet and an outlet, said diffuser being in fluid communication with said inflow pipe and receiving the fluid from said inflow pipe through said inlet; and a plurality of straightening vanes having first ends and second ends, said first ends being disposed adjacent to said inlet of said diffuser, said first ends of said vanes being positioned at said inlet according to a velocity distribution of the fluid flowing within said inflow pipe, said second ends being disposed adjacent to said outlet of said diffuser, said second ends being positioned at said outlet to uniformly divide a cross sectional area of said diffuser at said outlet into substantially equal sub-areas, whereby said straightening vanes provide substantially uniform velocity of the fluid at said outlet of said diffuser.

6. A straightening apparatus comprising:

an inflow pipe having a fluid flowing therethrough;

a diffuser having an inlet and an outlet, said diffuser being in fluid communication with said inflow pipe and receiving the fluid from said inflow pipe through said inlet, said diffuser further including space portions formed by walls of said diffuser and disposed adjacent to said inlet which increase the cross sectional area of said diffuser relative to a cross sectional area of said inflow pipe; and a plurality of straightening vanes disposed within said diffuser, at least two straightening vanes having means for separating flow of the fluid from said space portions, said separating means controlling an exit flow direction of the fluid from said outlet of said diffuser.

7. The straightening apparatus of claim 6, wherein each of said separating means includes a shutter plate arrangement.

* * * * *